US007793369B2

(12) United States Patent
Guguin et al.

(10) Patent No.: US 7,793,369 B2
(45) Date of Patent: Sep. 14, 2010

(54) BED HAVING A RETRACTABLE SIDE BARRIER MOVABLE TO MULTIPLE PREDETERMINED POSITIONS

(75) Inventors: Pascal Guguin, Brech (FR); Thierry Jaffre, Pluvigner (FR); Philippe Kaikenger, Paris (FR); Stephane Frayssinet, Quiberon (FR)

(73) Assignee: Hill-Rom SAS, Pluvigner (FR)

( * ) Notice: Subject to any disclaimer, the term of this patent is extended or adjusted under 35 U.S.C. 154(b) by 0 days.

(21) Appl. No.: 12/236,871

(22) Filed: Sep. 24, 2008

(65) Prior Publication Data

US 2009/0119839 A1 May 14, 2009

(30) Foreign Application Priority Data

Sep. 28, 2007 (FR) ..... 07 57928

(51) Int. Cl.
*A47C 27/08* (2006.01)

(52) U.S. Cl. ..... 5/425; 5/424; 5/428; 5/430; 292/137; 292/163

(58) Field of Classification Search ..... 5/424, 5/425, 428, 430; 292/137, 145, 150, 163, 292/175

See application file for complete search history.

(56) References Cited

U.S. PATENT DOCUMENTS

| | | | |
|---|---|---|---|
| 2,195,955 | A | 4/1940 | Hillenbrand |
| 2,478,028 | A | 8/1949 | Travis |
| 2,587,291 | A | 2/1952 | Des Rochers |
| 2,658,211 | A | 11/1953 | Bendersky |
| 2,676,341 | A | 4/1954 | Leone et al. |
| 2,722,017 | A | 11/1955 | Burst et al. |
| 2,766,463 | A | 10/1956 | Bendersky |
| 2,817,854 | A | 12/1957 | Pratt |
| 2,817,855 | A | 12/1957 | Pratt |
| 2,871,490 | A | 2/1959 | Balonick |
| 3,002,200 | A | 10/1961 | Murcott |
| 3,012,255 | A | 12/1961 | Diehl |
| 3,023,781 | A | 5/1962 | Constanti |
| 3,045,259 | A | 7/1962 | Mayer |
| 3,055,020 | A | 9/1962 | Mann |
| 3,081,463 | A | 3/1963 | Williams et al. |
| 3,220,024 | A | 11/1965 | Nelson |
| 3,419,922 | A | 1/1969 | Malherbe |
| 3,506,989 | A | 4/1970 | Ross et al. |
| 3,526,008 | A | 9/1970 | Pruim |

(Continued)

FOREIGN PATENT DOCUMENTS

| | | | |
|---|---|---|---|
| DE | 3510707 | A1 | 10/1986 |

(Continued)

*Primary Examiner*—Robert G Santos
*Assistant Examiner*—Nicholas Polito
(74) *Attorney, Agent, or Firm*—Barnes & Thornburg LLP

(57) ABSTRACT

A bed is disclosed having a retractable side barrier that is retractable by moving in rotation and in translation, and that is controllable using one hand only, by means of a handle incorporated into the barrier. The barrier element is associated with a deformable-parallelogram mechanism including a deployment bar provided with a cam profile with which a latch co-operates that is actuated by a handle in order to release it from said cam profile, said latch co-operating with abutments of said cam profile to define at least one stable position for said deformable-parallelogram mechanism.

15 Claims, 5 Drawing Sheets

U.S. PATENT DOCUMENTS

| | | | | |
|---|---|---|---|---|
| 3,585,659 | A | 6/1971 | Burst et al. | |
| 3,641,598 | A | 2/1972 | Feldstein | |
| 3,840,917 | A | 10/1974 | Taylor | |
| 3,851,345 | A | 12/1974 | Benoit et al. | |
| 3,855,654 | A | 12/1974 | Pivacek | |
| 3,865,434 | A | 2/1975 | Sully | |
| 3,930,273 | A * | 1/1976 | Stern | 5/430 |
| 3,932,903 | A | 1/1976 | Adams et al. | |
| 3,971,083 | A | 7/1976 | Peterson | |
| 4,103,376 | A | 8/1978 | Benoit et al. | |
| 4,183,015 | A | 1/1980 | Drew et al. | |
| 4,186,456 | A | 2/1980 | Huempfner | |
| 4,612,679 | A | 9/1986 | Mitchell | |
| 4,641,385 | A | 2/1987 | Peters et al. | |
| 4,653,129 | A | 3/1987 | Kuck et al. | |
| 4,747,171 | A | 5/1988 | Einsele et al. | |
| 4,949,410 | A | 8/1990 | Failor et al. | |
| 4,985,946 | A | 1/1991 | Foster et al. | |
| 4,987,623 | A | 1/1991 | Stryker et al. | |
| 4,993,089 | A | 2/1991 | Solomon et al. | |
| 5,083,334 | A | 1/1992 | Huck et al. | |
| 5,129,117 | A | 7/1992 | Celestina et al. | |
| 5,187,824 | A | 2/1993 | Stryker | |
| 5,394,580 | A * | 3/1995 | Foster et al. | 5/620 |
| 5,604,942 | A | 2/1997 | Allevato et al. | |
| 5,732,423 | A | 3/1998 | Weismiller et al. | |
| 5,784,732 | A | 7/1998 | Vail | |
| 5,802,636 | A | 9/1998 | Corbin et al. | |
| 5,878,452 | A | 3/1999 | Brooke et al. | |
| 6,021,533 | A | 2/2000 | Ellis et al. | |
| 6,167,580 | B1 | 1/2001 | Draheim et al. | |
| 6,182,310 | B1 | 2/2001 | Weismiller et al. | |
| 6,253,397 | B1 | 7/2001 | Bartow et al. | |
| 6,360,385 | B1 | 3/2002 | Lewandowski | |
| 6,397,416 | B2 | 6/2002 | Brooke et al. | |
| 6,446,283 | B1 | 9/2002 | Heimbrock et al. | |
| 6,519,794 | B1 * | 2/2003 | Aarestad et al. | 5/430 |
| 6,622,323 | B2 | 9/2003 | Ganance et al. | |
| 6,640,361 | B2 | 11/2003 | Heimbrock et al. | |
| 6,658,680 | B2 | 12/2003 | Osborne et al. | |
| 6,691,345 | B2 | 2/2004 | Nanahara | |
| 6,751,815 | B2 | 6/2004 | Heimbrock et al. | |
| 6,779,209 | B2 | 8/2004 | Ganance | |
| 6,829,793 | B2 | 12/2004 | Brooke et al. | |
| 6,851,142 | B2 | 2/2005 | Stryker et al. | |
| 6,874,179 | B2 | 4/2005 | Hensley et al. | |
| 6,938,289 | B2 | 9/2005 | Morin | |
| 6,951,036 | B2 | 10/2005 | Lemire | |
| 7,028,352 | B2 | 4/2006 | Kramer et al. | |
| 7,073,219 | B2 * | 7/2006 | Poulin et al. | 5/425 |
| 7,073,220 | B2 | 7/2006 | Simmonds et al. | |
| 7,082,630 | B2 * | 8/2006 | Castonguay et al. | 5/430 |
| 7,107,637 | B2 | 9/2006 | Kuek et al. | |
| 7,412,734 | B2 | 8/2008 | Stryker et al. | |
| 7,712,167 | B2 * | 5/2010 | Guguin et al. | 5/430 |
| 2002/0144348 | A1 | 10/2002 | Ganance | |
| 2003/0167568 | A1 * | 9/2003 | Brooke | 5/430 |
| 2009/0007334 | A1 | 1/2009 | Stryker et al. | |

FOREIGN PATENT DOCUMENTS

| | | | |
|---|---|---|---|
| EP | 0 680 714 | A1 | 11/1995 |
| EP | 1 053 735 | A2 | 11/2000 |
| EP | 1 108 410 | A2 | 6/2001 |
| EP | 1 243 207 | A1 | 9/2002 |
| JP | 09206177 | A | 8/1997 |
| JP | 09276340 | A | 10/1997 |
| WO | WO 98/17153 | | 4/1998 |
| WO | WO 02/32271 | A1 | 4/2002 |
| WO | WO 03/070061 | A1 | 8/2003 |
| WO | WO 2007/019692 | A1 | 2/2007 |

* cited by examiner

BED HAVING A RETRACTABLE SIDE BARRIER MOVABLE TO MULTIPLE PREDETERMINED POSITIONS

The present application claims priority, under 35 U.S.C. §119(a), of French National Application No. 07 57928 which was filed Sep. 28, 2007 and which is hereby incorporated by reference herein.

BACKGROUND

The present disclosure relates to a bed having a retractable side barrier, and more particularly to a patient's bed having at least one of its longitudinal edges equipped with such a barrier that is suitable for being placed in a position chosen from among a plurality of possible predetermined positions. The present disclosure further relates to an improvement facilitating manipulation and making it possible, in particular, to change the position of the barrier using only one hand, if desired.

A bed having a retractable side barrier is known that is of the type having at least one barrier element associated with a pivotally mounted deformable-parallelogram mechanism that is hinged to a frame of the bed. The term "frame" is used to mean all of the stationary or angularly positionable elements that support the mattress. Such a mechanism comprises two parallel arms, each of which is provided with a hinge for hinging it to said frame and with a hinge for hinging it to the barrier element, and a deployment bar hinged between the two arms. The purpose of the deployment bar that "closes" the parallelogram is to make the movement of the system more reliable by avoiding jamming.

Such a barrier element further comprises a locking system that makes use of the deployment bar. More particularly, a cam profile is integral with said deployment bar and the locking system co-operates with said cam profile so as to define a plurality of stable predetermined positions for the barrier element. Conventionally, provision is made for a high position in which the barrier element is raised to the maximum extent on the side of the bed so as to prevent the patient from falling out, and for a low position in which the barrier element is lowered to the same level as the lying surface. The low position is taken up when treatment or care is to be administered to the patient, or when it is desired to transfer the patient.

The known locking system is complex and, in particular, requires two hands to be used in order to operate the barrier, one hand being necessary to lock or to unlock the mechanism, and the other hand being necessary to control the upward or downward movement of the barrier.

SUMMARY

The disclosed barrier provides an improvement to the type of barrier known in the art, making it possible to simplify holding thereof.

More particularly, the present disclosure describes a bed having a retractable side barrier, which bed is of the type having at least one barrier element associated with a pivotally mounted deformable-parallelogram mechanism that is hinged to a frame of the bed, said mechanism comprising two parallel arms, each of which is provided with a hinge for hinging it to said frame and with a hinge for hinging it to said barrier element, a deployment bar hinged between the two arms, and a locking system arranged between said barrier element and a cam profile that is integral with said deployment bar, wherein said locking system comprises a latch mounted to slide relative to said barrier element, and a pull actuator handle carried by said barrier element, and suitable for releasing said latch from said cam profile, said latch co-operating with abutments of said cam profile to define at least one stable predetermined position for said deformable-parallelogram mechanism.

It should be noted that, with the above-described structure, raising the barrier via the handle relieves the latch of any load and moves it away from the cam profile. Therefore, so long as the barrier is held and operated via the handle, its movement, in particular, depending on circumstances, its downward movement, can be controlled using only one hand.

In some contemplated embodiments, the latch is urged resiliently towards the cam profile, e.g. by means of a spring. Therefore, if the user operates the barrier element by taking hold of it via a portion other than the handle, the latch is constrained to follow said cam profile and to meet one or other of a plurality of abutments defined thereon, making it possible to stabilize the barrier element in a predetermined position. Under all circumstances, operation can be performed with only one hand, if desired.

In some embodiments, the handle is embedded in the thickness of the barrier element and is mounted to move in an open cavity therein. The cavity opens to the outside so as to restrict operation to operation by hospital staff.

In order to define the high position, the cam profile may include a notch forming a double abutment into which said latch is engaged when the barrier element is in the high position.

The cam profile also, in some embodiments, includes an intermediate abutment against which said latch comes into abutment when the barrier element is in the intermediate position. In this intermediate position, the barrier element is not fully lowered and can thus be grasped by the patient in order to help the patient get out of bed.

This intermediate position is particularly useful when said barrier comprises two adjacent barrier elements associated with respective ones of two deformable-parallelogram mechanisms configured to move in opposite directions. When locked in the high position, the two barrier elements extend one after the other without much, if any, gap between them, thereby preventing any possibility of the patient falling out.

Conversely, when in the intermediate position, the two barrier elements are spaced apart from each other and an exit gap is then formed between them so as to enable the patient to leave the bed.

This exit gap is stabilized when the latches of the two barrier elements are in contact with the corresponding above-mentioned intermediate abutments.

BRIEF DESCRIPTION OF THE DRAWINGS

The side barrier disclosed herein can be better understood and other advantages thereof appear more clearly from the following description of a currently contemplated embodiment of a bed that conforms to the principle of the invention, the description being given merely by way of example and with reference to the accompanying drawings, in which.

DETAILED DESCRIPTION

Figure 1:
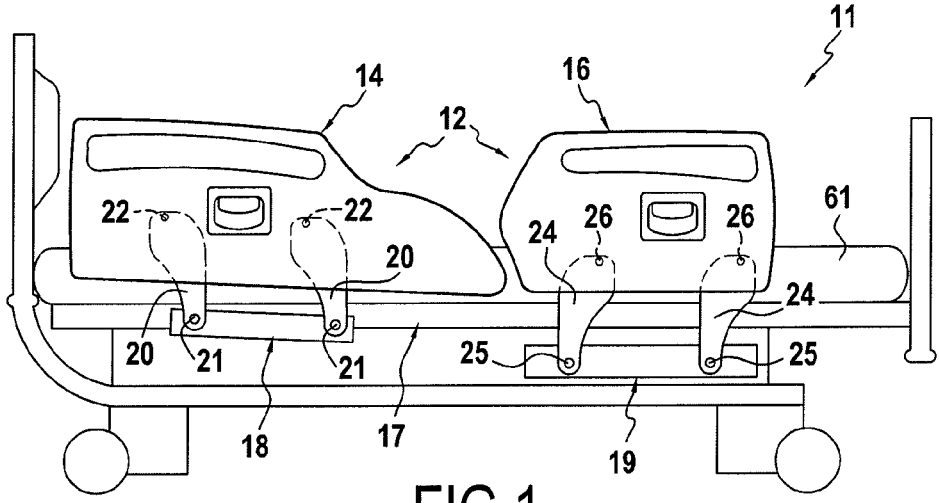
FIGS. 1 to 3 are diagrammatic views of a bed having a retractable side barrier comprising two adjacent barrier elements shown respectively in the high position, in the intermediate position, and in the low position.

The drawings show a patient's bed 11 provided with a retractable side barrier that is, in this example, of the type having two barrier elements, respectively a head barrier element 14 and a foot barrier element 16, each of which is associated with a deformable-parallelogram mechanism 18, 19 hinged to the frame 17 of the bed.

Each deformable-parallelogram mechanism pivots in its own plane, substantially parallel to the edge of the bed. There is thus a head deformable-parallelogram mechanism 18 carrying the head barrier element 14 and a foot deformable-parallelogram mechanism 19 carrying the foot barrier element 16.

The head deformable-parallelogram mechanism 18 comprises two parallel arms 20, each of which is provided with a hinge 21 for hinging it to said frame and with a hinge 22 for hinging it to the head barrier element.

In analogous manner, the foot deformable-parallelogram mechanism 19 comprises two parallel arms 24, each of which is provided with a hinge 25 for hinging it to the frame and with a hinge 26 for hinging it to the foot barrier element 16.

In the illustrated embodiment, each mechanism further comprises a "deployment" bar 30 hinged between the two arms. The primary function of the deployment bar is to make the movement of the deformable parallelogram more reliable by avoiding jamming.

The deployment bar 30 of the foot deformable-parallelogram mechanism 19 can be seen in FIGS. 4 to 7. It is received in a cavity 32 in the barrier element 16. The two arms 20 are outside said cavity, and each of them is provided with a hinge 34 for hinging it to the deployment bar, which hinge is constituted by a pin passing through a curved slot 36 provided in the wall of the cavity 32.

In addition, a locking system (see FIGS. 4 to 7) is arranged between each barrier element 14 or 16 and a cam profile 35 integral with the corresponding deployment bar 30. In the example, the cam profile 35 is implemented merely by forming a particular cutout configuration in the top edge of the deployment bar, which cutout configuration is described below. Thus, for the foot barrier element 16, the locking system comprises a latch 40 mounted to slide in a guide 41 in the barrier element that is perpendicular to the deployment bar 30, and the end of the latch co-operates with abutments in the cam profile 35 to define a plurality of stable predetermined positions for the deformable-parallelogram mechanism. A spring 38 is mounted in the guide 41 between an abutment therein and a shoulder of the latch 40, so as to urge said latch towards the cam profile. The top end of the latch is connected to an actuator handle 42 mounted to be pulled (upwards), making it possible to release the latch 40 from the cam profile 35.

The handle is arranged so that the barrier element can be operated rapidly by holding it with one hand via the handle in the pulled position. In the disclosed example, said handle 42 is embedded in the thickness of said barrier element and is mounted to move in an open cavity 44 therein.

The locking system for locking the head barrier element 14 is similar to the above-described locking system for locking the foot barrier element 16; the head barrier element locking system is not shown in the drawings.

It can be noted that, for the head barrier element 14, the positions of the hinge pins 21 for hinging the arms 20 to the frame 17 and of the hinge pins 22 for hinging the arms 20 to the barrier element 14 are such that said barrier element naturally, under the effect of its own weight, tends to effect a movement in rotation and in translation firstly towards the head of the bed and downwards, and then in the opposite direction and also downwards to the low position.

For the foot barrier element, the movement is different. Under the effect of its weight, the foot barrier element 16 naturally tends to move downwards in a movement in rotation and translation towards the foot of the bed and downwards.

Figure 2:
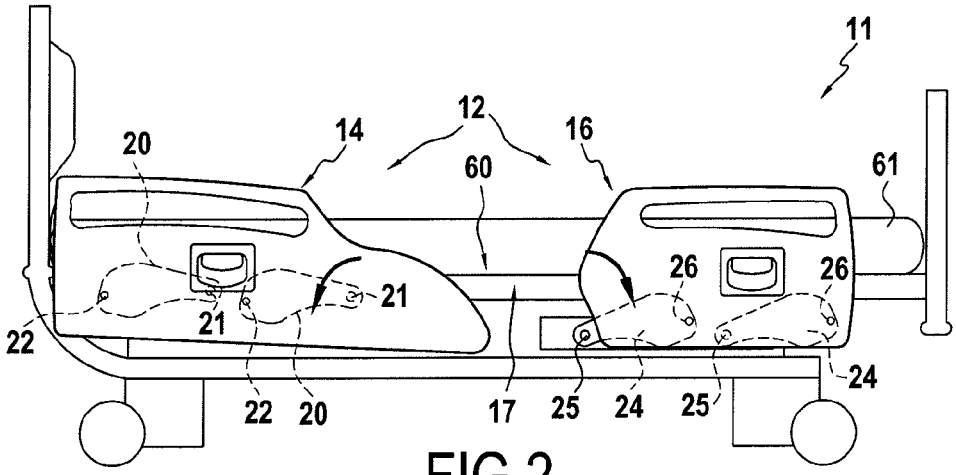
Figure 3:
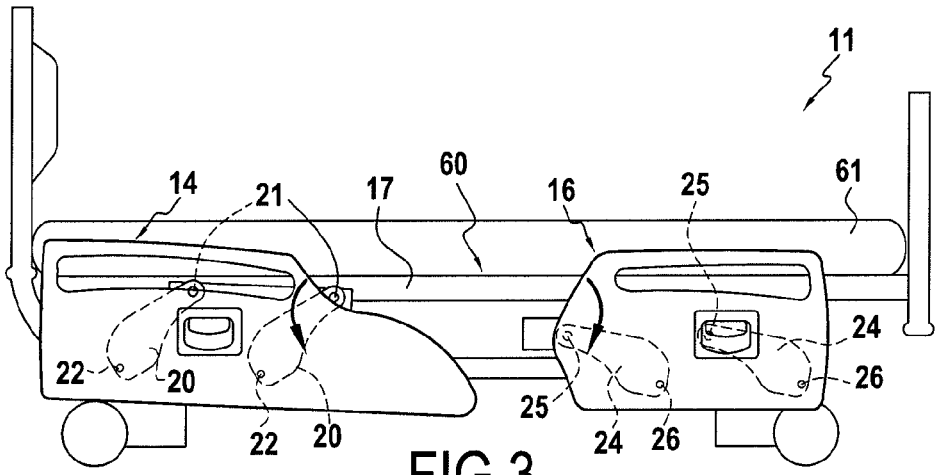

As a result, when each of the two barrier elements 14, 16 are in an intermediate position, lowered to some extent relative to the high position, a gap (FIG. 2) is formed between the two barrier elements that is sufficient to enable the patient to leave the bed. It is thus particularly noteworthy, for each barrier element, for one of the above-mentioned stable positions (determined by the latch co-operating with an abutment of the cam profile) to be in said intermediate position, so as to create, and so as to stabilize, the exit gap 60. This is made possible by the configuration of the illustrated embodiment.

Figure 4:
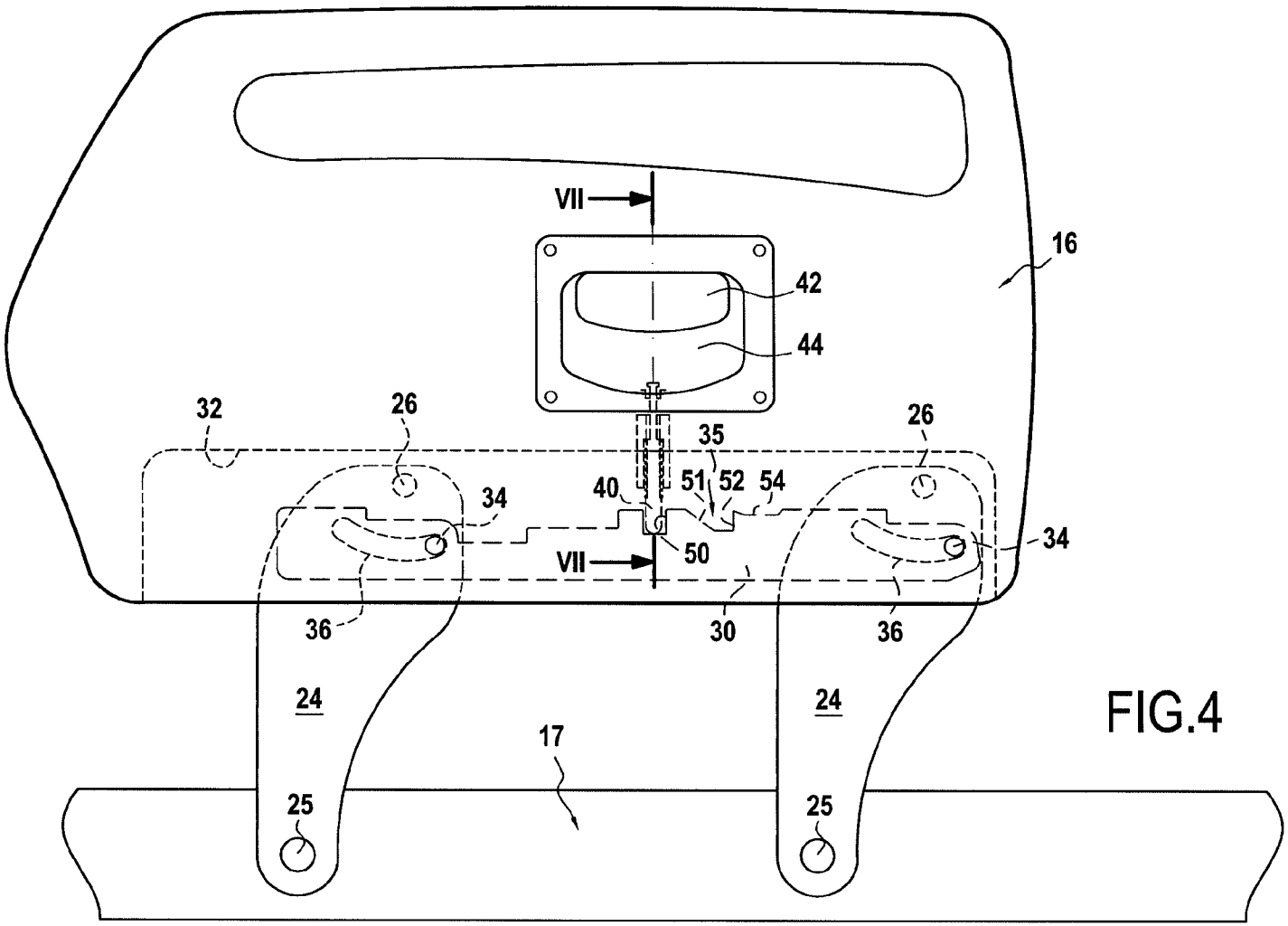
FIGS. 4 to 6 are diagrammatic detail views showing a barrier element respectively in the high position, in the intermediate position, and in the low position.
Figure 5:
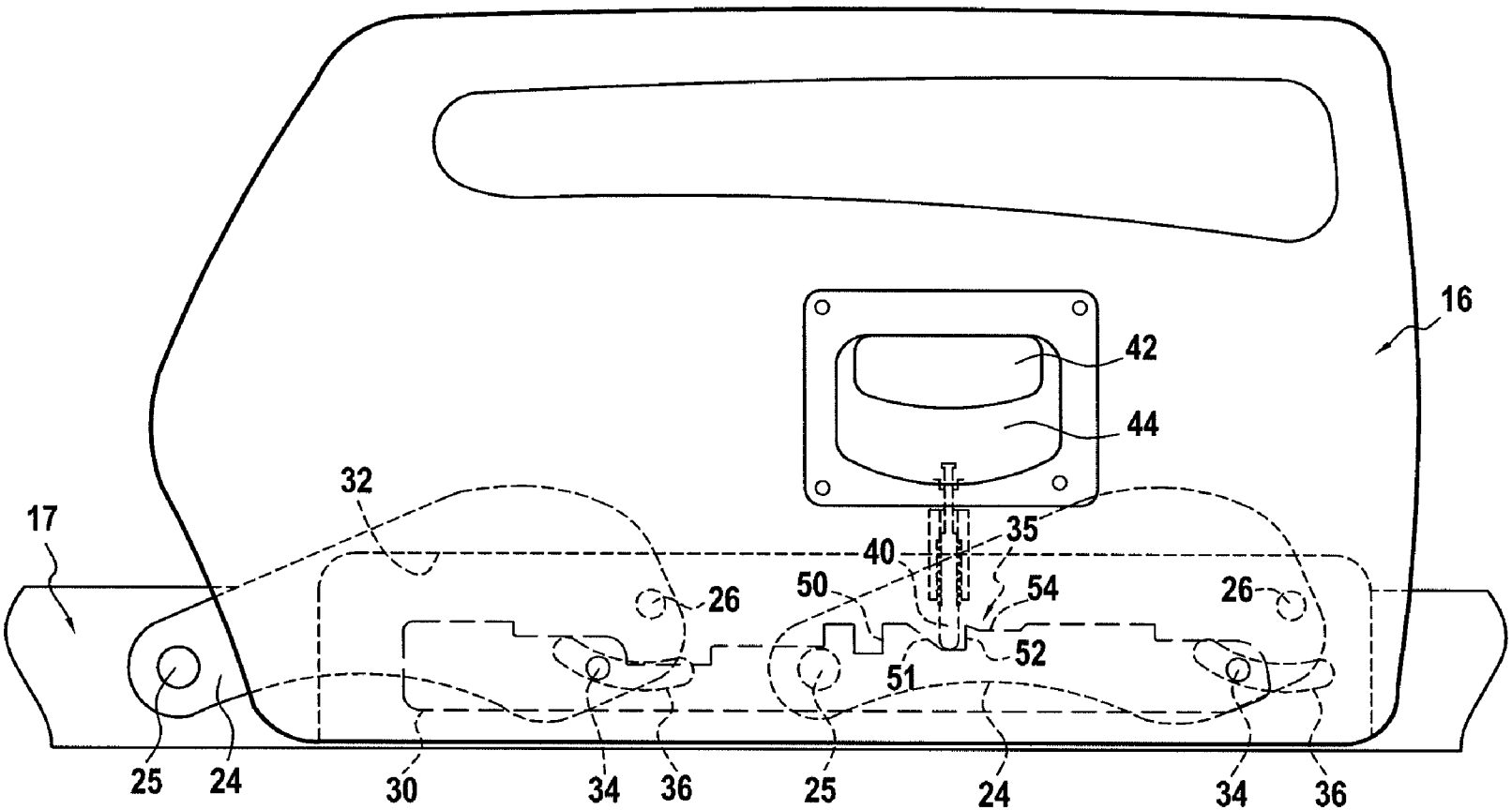
Figure 6:
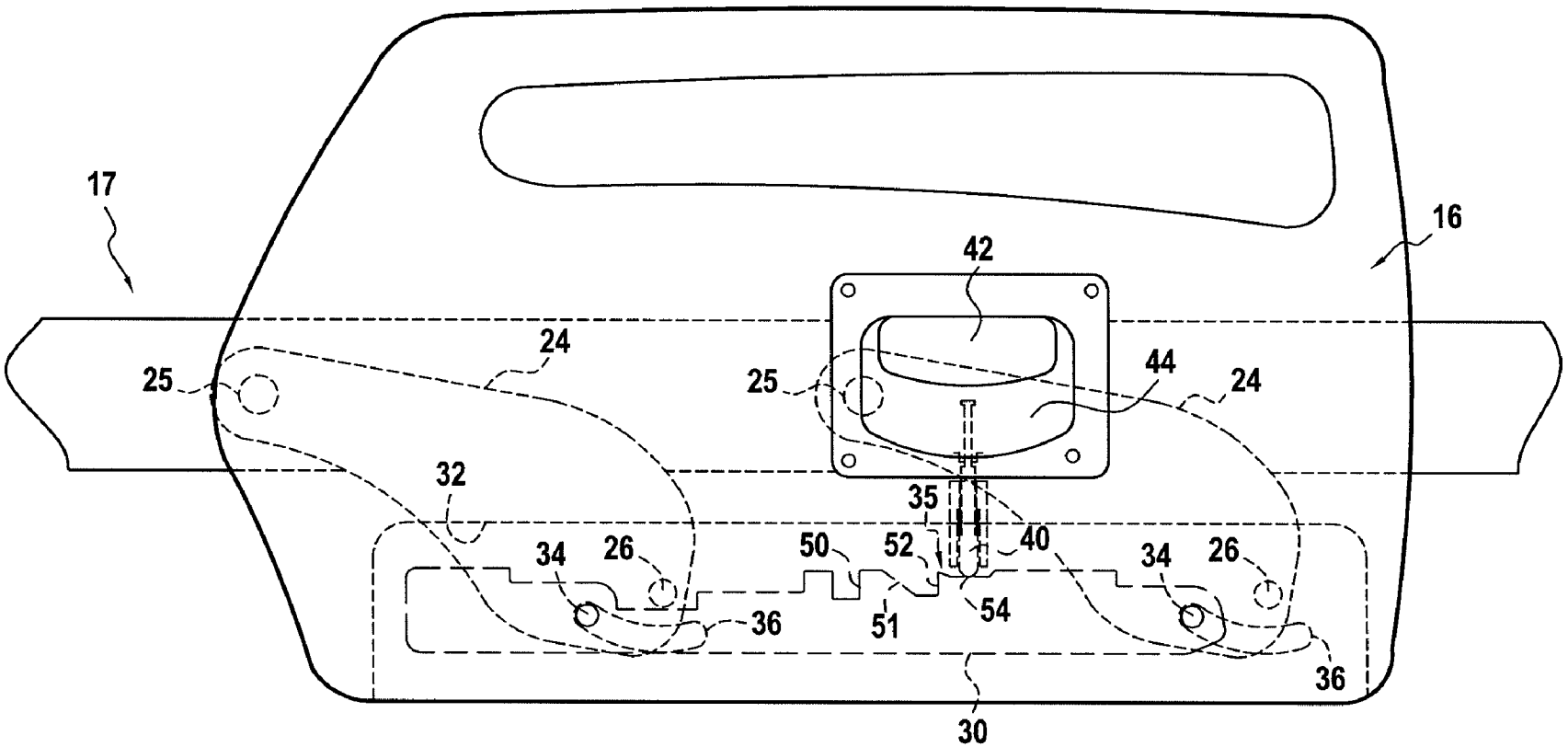
Figure 7:
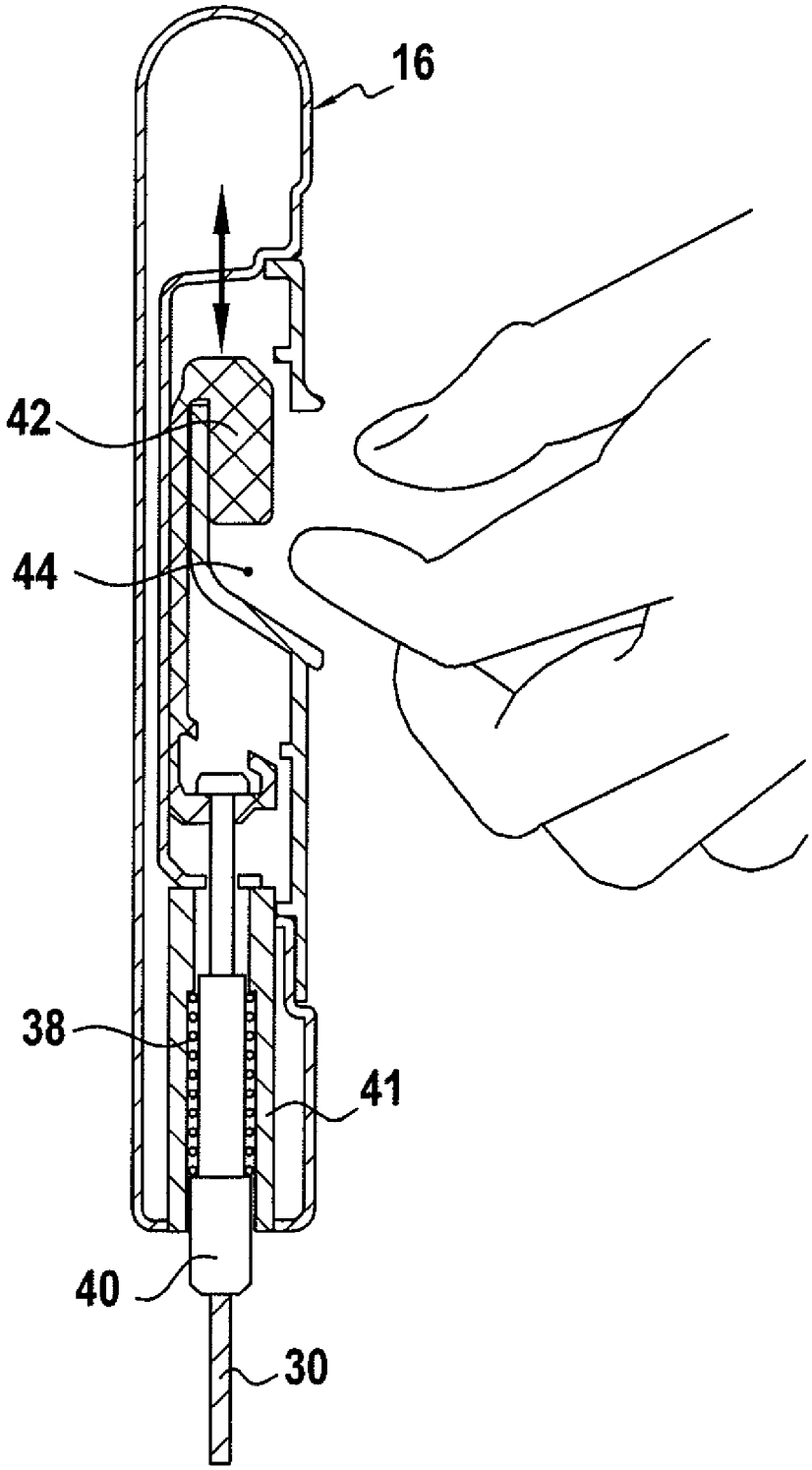
FIG. 7 is a view taken along section VII-VII of FIG. 4.

The cam profile is described below with reference to FIGS. 4 to 6 that more particularly show the foot barrier element. The cam profile of the head barrier element is similar and is not described in detail.

It should be noted that the cam profile includes a notch 50 forming a double abutment into which the latch 40 engages when the barrier element is in the high position. Thus, when the latch is engaged in said notch, the barrier element cannot be moved, unless action is taken on the handle 42. To the right of said notch 50, as shown in the figures, the cam profile continues with a ramp 51 that extends to an intermediate abutment 52 against which said latch comes into abutment when the barrier element is in the intermediate position (FIG. 5). To the right of said intermediate abutment 52, as shown in the drawings, the cam profile extends via a horizontal rectilinear segment 54 against which the end of the latch moves while the barrier is going from the intermediate position to the low position. The low position is stabilized by the pins of the hinges 34 co-operating with the ends of the curved slots 36. The low position could also be stabilized by the latch co-operating with an additional abutment of the cam profile.

Operation is as follows. When the barrier element is in the high position, the latch 40 is engaged in the notch 50 and the barrier element is fully locked. When an operator takes hold of the handle 42 and pulls it upwards, said operator releases the latch 40 from the notch 50 at the same time as supporting the barrier element, and does so with one hand only, if desired. Whereupon, the barrier element can be lowered by its natural movement in rotation and in translation to the low position, merely by holding back the natural movement of the barrier element.

When it is desired to raise the barrier element again, it is not necessary to take hold of the handle 42. Said barrier element can be raised by taking hold of it by any other part of it. In which case, the latch 40 follows the above-defined cam profile. Starting from the horizontal surface, it goes past the intermediate abutment 52, whereafter, if the barrier element is released, it is automatically stabilized in the intermediate position. On continuing to raise the barrier element, the latch is caused to continue to move along the ramp until it engages into the notch 50 again, thereby causing the barrier element to be locked in the high position.

When the two barrier elements 14, 16 are in the intermediate position (FIG. 2), it can be observed that the exit gap 60 is formed, so as to enable the patient to get up by sitting on the edge of the mattress 61 between the two barrier elements. The patient can take hold of them and lean on them in order to get up.

It should be noted that, if the state of the patient so permits, the head barrier element 14 can be left in the high position or in the intermediate position and the foot barrier element 16 can be left in the lowered position. In which case, if the patient wishes to get up, said patient can sit on the edge of the bed and use one hand to raise the foot barrier element 16 to an intermediate position. The patient then has two handholds on which to lean in order to get up. For that purpose, the patient does not need to act on the handle 42 (which is not accessible to the patient) because the barrier element can always be raised freely in the illustrated example.

The invention claimed is:

1. A bed having a retractable side barrier, which bed is of the type having at least one barrier element associated with a pivotally mounted deformable-parallelogram mechanism that is hinged to a frame of the bed, said mechanism comprising two parallel arms, each of which is provided with a hinge for hinging it to said frame and with a hinge for hinging it to said barrier element, a deployment bar hinged between the two arms, and a locking system arranged between said barrier element and a cam profile that is integral with said deployment bar, wherein said locking system comprises a latch mounted to slide relative to said barrier element, and a pull actuator handle carried by said barrier element and suitable for releasing said latch from said cam profile, said latch co-operating with abutments of said cam profile to define at least one stable predetermined position for said deformable-parallelogram mechanism, wherein said cam profile is formed along an uppermost edge of said deployment bar.

2. A bed according to claim 1, wherein said latch is urged resiliently towards said cam profile.

3. A bed according to claim 1, wherein said handle is arranged such that the barrier element can be operated freely by holding it with one hand via the handle in a pulled position.

4. A bed according to claim 1, wherein said handle is embedded in a thickness of said barrier element and is mounted to move in an open cavity therein.

5. A bed according to claim 1, wherein said cam profile includes a notch forming a double abutment into which said latch is engaged when the barrier element is in a high position.

6. A bed according to claim 1, wherein said cam profile includes an intermediate abutment against which said latch comes into abutment when the barrier element is in an intermediate position between a high position and a low position.

7. A bed according to claim 1, wherein the at least one barrier element comprises two adjacent barrier elements associated with respective ones of two deformable-parallelogram mechanisms configured to move in opposite directions, so that it is possible to move the two barrier elements apart and to form an exit gap between them, through which the patient can exit.

8. A bed according to claim 6, wherein when the two barrier elements move apart to form the exit gap between them, through which the patient can exit, said exit gap is stabilized when latches of the two barrier elements are in contact with corresponding intermediate abutments of respective cam profiles, thereby holding the two barrier elements in the intermediate position against downward movement.

9. A bed according to claim 1, wherein said latch is movable vertically into and out of engagement with the cam profile.

10. A bed according to claim 9, wherein said handle is coupled to said latch and said handle is moved upwardly to move the latch upwardly away from the cam profile to unlock the barrier element.

11. A bed according to claim 1, wherein the deployment bar is an elongated bar that is oriented generally horizontally.

12. A bed according to claim 1, wherein the deployment bar translates generally horizontally relative to the barrier element as the barrier element is raised and lowered.

13. A bed according to claim 12, wherein pivoting of the parallel arms causes the translation of the deployment bar relative to the barrier element.

14. A bed according to claim 1, wherein the barrier element includes a cavity in which the deployment bar is received.

15. A bed according to claim 14, wherein the deployment bar is hidden from view within the cavity.

* * * * *